US005975443A

United States Patent [19]

Hundt et al.

[11] Patent Number: 5,975,443

[45] Date of Patent: Nov. 2, 1999

[54] WASTE RECYCLING DEVICE

[76] Inventors: Vincent G. Hundt, Rte. 1, Box 392, Coon Valley, Wis. 54623; Frederick G. Peltz, 26902 County Rd. 10, P.O. Box 301, St. Martin, Minn. 56376

[21] Appl. No.: 08/908,470

[22] Filed: Aug. 6, 1997

Related U.S. Application Data

[60] Provisional application No. 60/022,441, Aug. 8, 1996.

[51] Int. Cl.[6] ..... B02C 13/31

[52] U.S. Cl. ..... 241/27; 241/32; 241/73; 241/189.1

[58] Field of Search ..... 241/73, 32, 37, 241/37.5, 89.1, 27

[56] References Cited

U.S. PATENT DOCUMENTS

| | | | |
|---|---|---|---|
| 787,290 | 4/1905 | Griffn | 241/32 |
| 1,185,620 | 6/1916 | Blum | 241/73 |
| 1,772,321 | 8/1930 | Ossig | 241/32 |
| 2,579,767 | 12/1951 | Strawn | 241/32 |
| 2,794,438 | 6/1957 | Heth | 130/27 |
| 3,473,742 | 10/1969 | Montgomery | 241/32 |
| 3,659,794 | 5/1972 | Hemesath | 241/189 R |
| 3,716,196 | 2/1973 | Motek et al. | 241/27 |
| 5,213,273 | 5/1993 | Linnerz | 241/73 |
| 5,713,525 | 2/1998 | Morey | 241/32 |
| 5,743,472 | 4/1998 | Williams, Jr. et al. | 241/32 |

*Primary Examiner*—Mark Rosenbaum
*Attorney, Agent, or Firm*—M. Paul Hendrickson

[57] ABSTRACT

The present invention relates to unique waste recycling machines possessing improved efficacy in recycling bulky waste materials to a recycled waste product. The feed for the machine is equipped with a floating stripper plate which scrapes adhering waste materials from a continuous metal apron feed. The device also includes a releasable cradle assembly which supports a striking bar and a screen positioned about a rotating drum equipped with impacting teeth or blades. When a damaging obstacle enters an impacting or fragmenting zone of the machine, a shear pin which maintains the cradle assembly in a fragmenting position will shear causing the cradle assembly to become dislodged to an inoperable or non-damaging position. The machine also includes impacting teeth which are dynamically balanced and positioned upon a rotating impacting drum so as to effectuate especially effective fragmentation of waste materials to a desired particle size.

13 Claims, 14 Drawing Sheets

WASTE RECYCLING DEVICE

This patent application claims the benefit of provisional patent application Ser. No. 60/022,441 which was filed on Aug. 8, 1996.

FIELD OF THE INVENTION

The present invention relates to recycling machines and methods for recycling bulky materials and more particularly to machines and methods for processing of waste materials to a desired particle size and bulk density.

BACKGROUND OF THE INVENTION

The current economy generates vast tonnages of wastes for disposal. Such wastes contain a multitude of diverse chemical components. Most unprocessed wastes exist as bulky materials which, in the unprocessed form, are usually unusable and occupy tremendous space. Landfill disposal no longer affords a satisfactory disposal solution to modern day wastes. Plastics, cellulosic materials (e.g. vegetative wood, paper, cardboard, etc.), glassware, waste foods and feeds, metals, agricultural, construction and industrial wastes, etc. generally comprise the bulk of such wastes. Certain waste collection sites and municipalities require a separation of wastes into different classes of waste materials such as a separation of paper, wood, metal cans, plastics, waste foods, etc. These separated wastes are desirably converted to less bulky materials and recyclable products such as recycled metals, recycled wood, (e.g. landscaping mulch and livestock bedding, pressed wood products), cellulosic products such as recycled paper, cardboard, cellulosic insulation, newsprint, livestock bedding, and other similar useful and saleable products. Processed wastes are also utilized as an energy source for powering commercial and industrial equipment such as in generating electricity and drying kilns.

Costly, heavy-duty equipment powered by energy-consuming motors operated at relatively high r.p.m. and momentum are generally needed to process such wastes. The recycling machines are designed to convert the wastes into a form suitable for resale or reuse. The waste recycling generally entails grinding the bulky waste material to a useful bulk density or particle size.

The problems associated with industrial waste disposal may be typified by the accumulation of wooden pallets at a heavy industrial manufacturing sites. Raw materials and components used by the manufacturer are customarily shipped upon wooden pallets which affords a convenient means for transporting the components about the manufacturing facility with forklift trucks. It is usually too costly to return, reship or reuse these wooden pallets. As a result, stockpiles of wooden pallets typically accumulate at the manufacturing site. Disposal of these bulky and space-consuming wood pallets becomes a troublesome and costly problem.

Waste materials are often prone to be contaminated with latent materials capable of causing considerable damage to the waste processing equipment. It is often economically unfeasible or undesirable to purify or refine waste materials so as to insure removal of machine damaging contaminants. This is typified by the processing of common wastes such as wood and garbage products which may often contain a machine damaging substance such as a large metal rod or rail, a rigid pry bar, etc. Conventional waste processing devices are poorly equipped with safety mechanisms capable of safely interrupting the mechanical operation or working of machine before extensive damage is caused to the device. This can result in extensive downtime for costly repairs and service. In the meantime, unprocessed wastes continue to accumulate at an unsafe and unhealthy rate. Another problem associated with conventional waste recycling devices is the propensity of the wastes to clog or foul the machinery. The need to frequently clean, maintain and repair untidy equipment leads to costly and prolonged downtime during which the wastes continually stockpile.

There exists a need for a high-capacity, waste recycling device capable of effectively handling a broad spectrum of waste materials to produce an end product of a desired uniformity and quality. A productive recycling machine capable of recycling stockpiled waste of conventional garbage and cellulosic materials (e.g. paper, wood, etc.) for prolonged operational periods without fouling or clogging would fulfill a long existing need within the waste disposal industry. A waste recycling machine equipped to productively handle large waste volumes at a relatively low rate of power or energy consumption would fulfill another existing need. Another prerequisitial need centers upon the need for a waste recycling machine equipped with different screen types which may be expeditiously removed and replaced by another screen so as to permit effective processing of different waste materials into end products of a desired uniformity. Another current need centers upon a desire for a high-capacity waste recycling device equipped so as to spontaneously interrupt its mechanical operation when subjected to potentially damaging hazards so as to avoid otherwise extensive damage and costly repairs to the processing equipment and injury to persons. Another desire is a need to provide a high volume and durable waste disposal device which can be effectively operated for prolonged mechanical working periods without requiring extensive downtime for maintenance and repair. These needs and other objectives are generally achieved by the unique waste recycling device of this invention and its use.

SUMMARY OF THE INVENTION

The present invention provides a waste recycling device or machine capable of processing a wide range of waste products to a desired end product. The recycling machine is designed to effectively handle large waste volumes. The recycling device of this invention may be continuously operated for prolonged operational periods without costly interruptions. Maintenance, repairs and downtime are substantially alleviated by unique features afforded by the present recycling machine. The recycling machine affords significant efficiencies in energy and power requirements so as to require a lesser horsepower than conventional devices for any given capacity.

The unique recycling machine includes a continuous metal apron comprised of metal apron sections hinged together so as to allow the metal apron to be continuously driven about spacer and drive sprockets. This provides for continuously feeding wastes for processing by the device. An adjustable floating stripper plate strategically positioned at a discharging apron end tangentially contacts the metal apron so as to cleanly strip waste materials from the apron. The apron is thus thoroughly cleaned of debris as it revolves about a discharge end sprocket (i.e. at juncture of changing its planar direction) and commences its return to a feed trough at the replenishing feed inlet. The adjustable floating stripper plate is pivotally or axially mounted at one end and biasingly leveraged against the apron through use of a tensioned adjusting bolt or bolts positioned at a biasing site. This allows the stripper plate to float freely upwardly and downwardly upon the metal apron. Springed adjusting bolts permit for an operational adjustment to the appropriate applied tension level by the stripper plate tip against the apron. The stripper plate serves to effectively remove and cleanly strip waste residue from the apron. Thus, any build up of adherent and potentially fouling substances upon the apron is thereby avoided. The freshly cleaned apron is then driven about a feed-end sprocket to a feed site wherein freshly replenished waste materials are again fed onto the apron for its return trip to the stripper plate.

The floating stripper plate is positioned in a juxtapositional feeding relationship to a striking bar so that material stripped from the feed apron freely flows onto a striking bar. Initial fragmentation of the waste feed is accomplished within a dynamically fragmenting zone comprised of a unique striking bar and a cylindrical rotor equipped with a balanced arrangement of breaker teeth. The striking bar serves as a supportive anvil for shearing waste material fed to the fragmenting zone. Upon impacting against waste supported by the striker bar, the shearing teeth pull and shred the supported waste in a downwardly and radially outwardly direction away from a cutting edge of the striking bar. The teeth, which exert a downwardly and radially outwardly pulling and shearing action upon waste material resting upon the anvil, are positioned (in relationship to a vertical line intersecting the axial shaft of the rotating cylinder assigned a value of 0 degrees) so as to make initial contact upon the waste at a radial arc ranging from about 26° to about 36° angle. The counterclockwise rotating cylinder equipped with tangential disposed removable breaker teeth is preferably positioned from about a 64° angle to about a 76° angle in relation to the striker bar. The net effect of this arrangement results in a highly effective shearing or fragmentation of the waste materials at the striking bar site.

The striking bar incorporates a unique releasing mechanism which allows the striking bar to become safely disengaged from the fragmenting zone when exposed to a damaging force exceeding the safety tolerance of the device. This is accomplished by means of a unique break-away cradle assembly which serves as a supportive structure for the striking bar and a removable screen. The striking bar may be structurally integrated into the supportive frame structure for the cradle assembly. Associated with the cradle assembly is a shearing means which, upon exposure of an excessive torquing force (e.g. a lodged damaging obstacle), will shear so as to cause the entire cradle assembly including the striking plate and screen to become disengagedly dislodged or removed to a disengaged unoperational position. The striker bar, which forms the leading edge of the cradle intake side, will thus, as in the case of the screen, be released to a non-damaging position upon exposure to a damaging obstacle which exceeds the shearing tolerance of a shear pin or shear bolt mechanism. The unique break-away feature afforded by the cradle assembly provides excellent mechanical protection against structural damage.

The screen is also cradled within a supportive cradle structure positioned about an arcuate section of the rotating cylinder. The screen also embodies several unique features which contributes a higher efficacy in the processing of waste materials. As mentioned, the screen and striking bar incorporate a unique break-away shearing mechanism. Further fragmentation of waste materials occurs as the fragmented waste is propelled by the toothed rotary cylinder across the grated surface of a replaceable screen. The screen serves to further fragment and grate the waste until the waste is reduced to appropriate sized particles for screening and recycling collection.

The cradle assembly advantageously includes an adjustable clearance means for adjusting the cradle so as to provide the appropriate clearance or distance between the rotating teeth, the striking bar and the screen. The unique cradle assembly of this invention permits a simultaneous adjustment of both the screen and striker bar to an operational clearance which, in turn, optimizes the waste fragmentation and screening efficiency for the particular waste being processed by the machine.

The shearing mechanism is operationally associated with the cradle assembly which uniquely breaks away from a processing or fragmenting zone when subjected to a damaging obstacle. The cradle assembly, which supports the screen and striking bar, is operationally connected to cammed shearing means. The supportive cradle is preferably pivotally or axially mounted at one end (distal or discharge side) and equipped at an opposing screen cradle end with a cammed shearing means operationally connected to the adjustable clearance means for adjusting the clearance between the striking bar, the screen and the rotor. The cammed shearing means, upon exposure to a force exceeding the desired shear limitations for the device, will shear the shear pin or shear bolt which in turn allows the cam to spontaneously pivotally rotate and immediately drop the supportive cradle along with its attached striking bar and supported screen to a safe and undamaging distance from the rotating teeth.

The cradled screen design also permits the screen to be conveniently removed and replaced with another simply by unsecuring the adjusting means and removing the screen from cradle. A boom mountable to a boom mount enables a single operator to readily remove and replace a cradled screen with another screen.

A unique feature provided by a cradle assembly in operative association with shear releasing means resides in a machinery capability to instantaneously break away from the rotating teeth when subjected to a potentially damaging obstacle creating a shearing force which exceeds the shearability threshold of the shear pin or shear bolt becomes lodged within the processing zone. The shear bolt or shear pin and supportive cradle assembly embodiments allow the device to be safely operated at a high revolutionary speed and momentum without undue concern over the latent presence of damaging obstacles in the waste. When a damaging obstacle is encountered, the shear pin or bolt will simply instantaneously shear causing the cam to rotate about its axial support and drop the cradled screen and striking bar to a safe and non-damaging clearance from the rotating teeth. In operation the cradled screen and striking bar may be further disengaged by untightening clearance adjusting means so as to provide a greater clearance for effective removal of lodged obstacles from the processing zone or for screen removal and replacement. After removing the damaging obstacle, a new shear bolt may be inserted into the screen and striking bar reset to an appropriate operative clearance for effective operation.

The unique waste processing machine provides an effective machine for the processing of conventional garbage and cellulosic objects such as paper and wood. These waste tend to form compacted materials which can readily lead to clogging or stalling of the device. The present device alleviates these problems and permits the unit to be utilized at a highly efficient processing capacity while substantially curtailing the energy requirements needed to process the wastes.

DETAILED DESCRIPTION OF THE INVENTION

Figure 1:
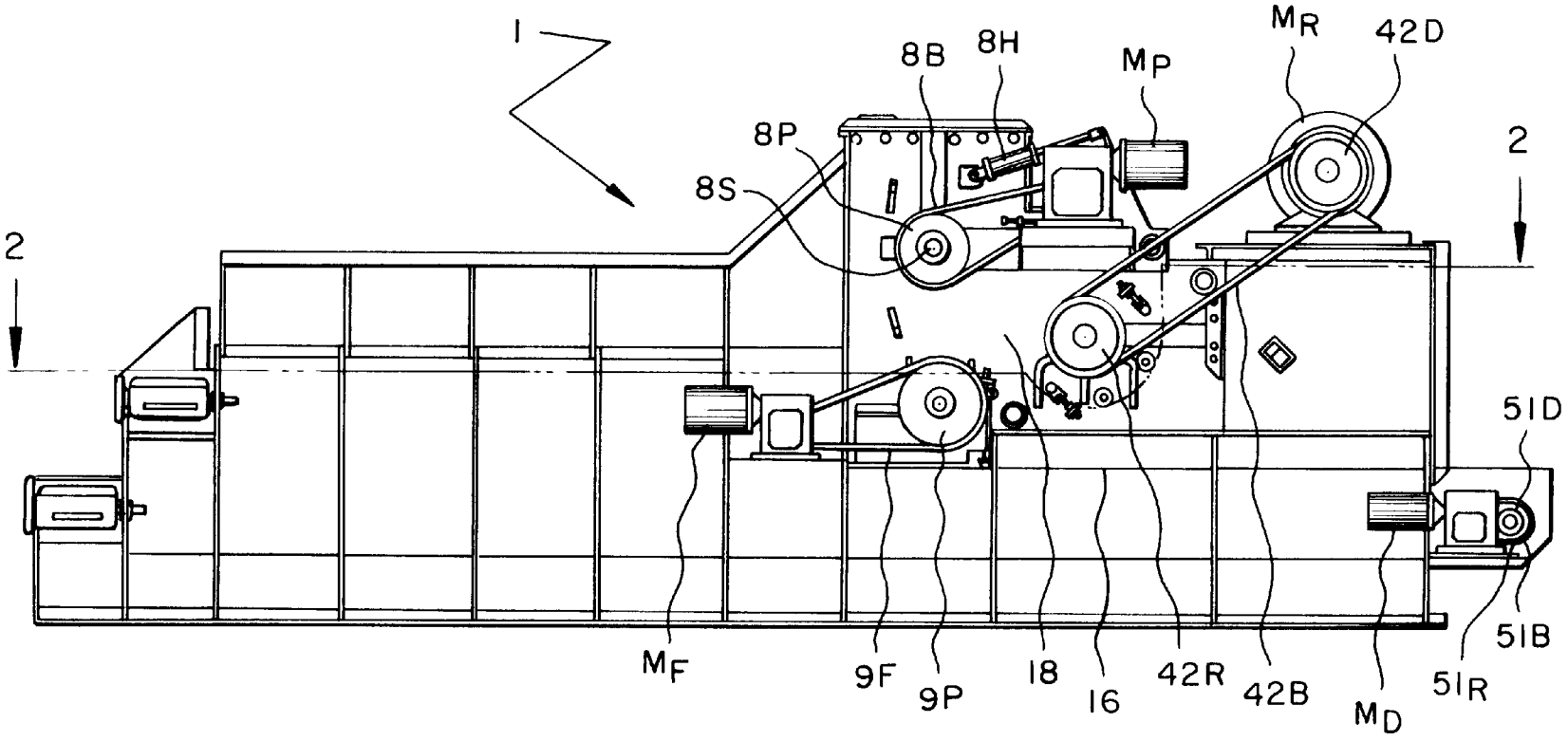
FIG. 1 depicts an external perspective side view of the device of this invention.

With reference to the figures, the basic mechanical operations of the depicted recycling machine (referenced in general as 1) include, in general, feeding means (defining a feeding zone generally enumerated as 3) for feeding wastes W to fragmenting means (generally depicted by 4) for fragmenting the waste to a desired particle size and bulk density and discharging means (defining a discharging zone and generally designated as 5) for discharging of processed or fragmented waste materials D from machine 1.

As depicted FIGS. 1–13, the present invention provides a unique releasable cradle assembly (generally designated by a 30 series enumeration) for use in a waste processing machine 1 comprised of an impacting rotor 40 equipped with impacting teeth 41 rotationally carried about a cylindrical drum 42 and a screen 43 for screening particulated wastes D therethrough, said cradle assembly 30 comprising:

a) a supportive cradle frame 31 for supportively securing screen 43 thereto;

b) a striking bar 33 carried by the frame 31 at a waste fragmenting position (shown as F);

c) releasing means (generally designated as 35) for disengaging the cradle assembly 30 from the fragmenting position F upon subjecting the cradle frame to an excessive shearing force; and d) adjustable clearance means (generally designated as 37) for adjusting the cradle assembly 30 to the waste fragmenting position F.

As further depicted by FIGS. 1–3 and 5–6, the waste recycling machine 1 is suitably equipped with a waste feed cleaning assembly 13 for cleaning waste residues W from the assembly 13, said waste cleaning assembly 13 comprising a conveying apron 9 continuously driven about laterally disposed pulleys 9D and 9E, an adjustable floating stripper plate 15 equipped with a scraper blade 15A tangentially contacting apron 9 so as to scrape the waste residues W from apron 9 and an adjustable biasing means 17 for adjusting a scraping force as applied by said scraper blade 15A against said conveyor 9. Waste residue W uniformly and cleanly scraped from the apron 9 by scraper 15 is then discharged to the fragmenting zone F for fragmentation to the desired particle sized waste D.

FIG. 1 depicts an external side view of the waste recycling machine 1 of this invention. The depicted machine 1 includes a sturdy frame 16 (shown more particularly in the cross-sectional views) of welded steel beams supportive of mechanical workings of machine 1. Since machine 1 is used to splinter and fragment wastes under great impacting forces, machine 1 is protectively covered with a sturdy plate metal shell 18. Appropriate powering means structurally anchored to frame 16 of machine 1 provides means for powering machine 1 as may also be observed in FIG. 1. Although machine 1 may be powered by a variety of appropriate power sources (e.g. internal combustion engines, diesel engines, hydraulic motors, industrial and tractor driven power take-offs, etc.), the depicted machine 1 is shown as being powered by several electrical motors generally prefixed by M. FIG. 1 depicts four electric motors equipped with suitable drive means for powering the various working components (namely the feeding, fragmenting and discharging means) of machine 1. As may be more specifically observed from FIG. 1, the four separate electrical motors M are used to separately power different drives and functions for machine 1. Feed motor $M_F$ powers feeding means 3 in cooperation with power feed motor $M_P$ which powers power feed 8. A rotary motor $M_R$ powers the fragmenting means of fragmenting rotor (generally represented as 40) and a discharging motor $M_D$ powers the discharging means for conveying discharged wastes D from machine 1.

The feeding means 3 (shown in greater detail in FIGS. 2 and 3) includes a hopper 7 for receiving waste materials W and a continuous apron 9 or conveying belt for feeding wastes W to waste fragmenting zone 4. The feeding means 3 incorporates into its operation a unique feed cleaning assembly (generally designated as 13 and shown in more detail by FIGS. 2, 3, 5, 6 and 9) for effectively cleaning waste residues W from apron 9.

Apron 9 is preferably constructed of rigid apron sections 9A (e.g. heavy-duty metal, plastic, etc.) hinged together by piano hinges 9B which are continuously driven about drive pulley 9D and idler pulley 9E respectively laterally disposed at opposing ends of apron 9. Apron 9 is typically operated at an apron speed of about 10 to about 30 feet per minute. Apron 9 may be connected to switching means (not shown) responsive to operational torquing forces as applied to impacting rotor 40 so as to switch off the apron feed when rotor 40 becomes filled to capacity with wastes W in the fragmenting zone 4.

Figure 5:
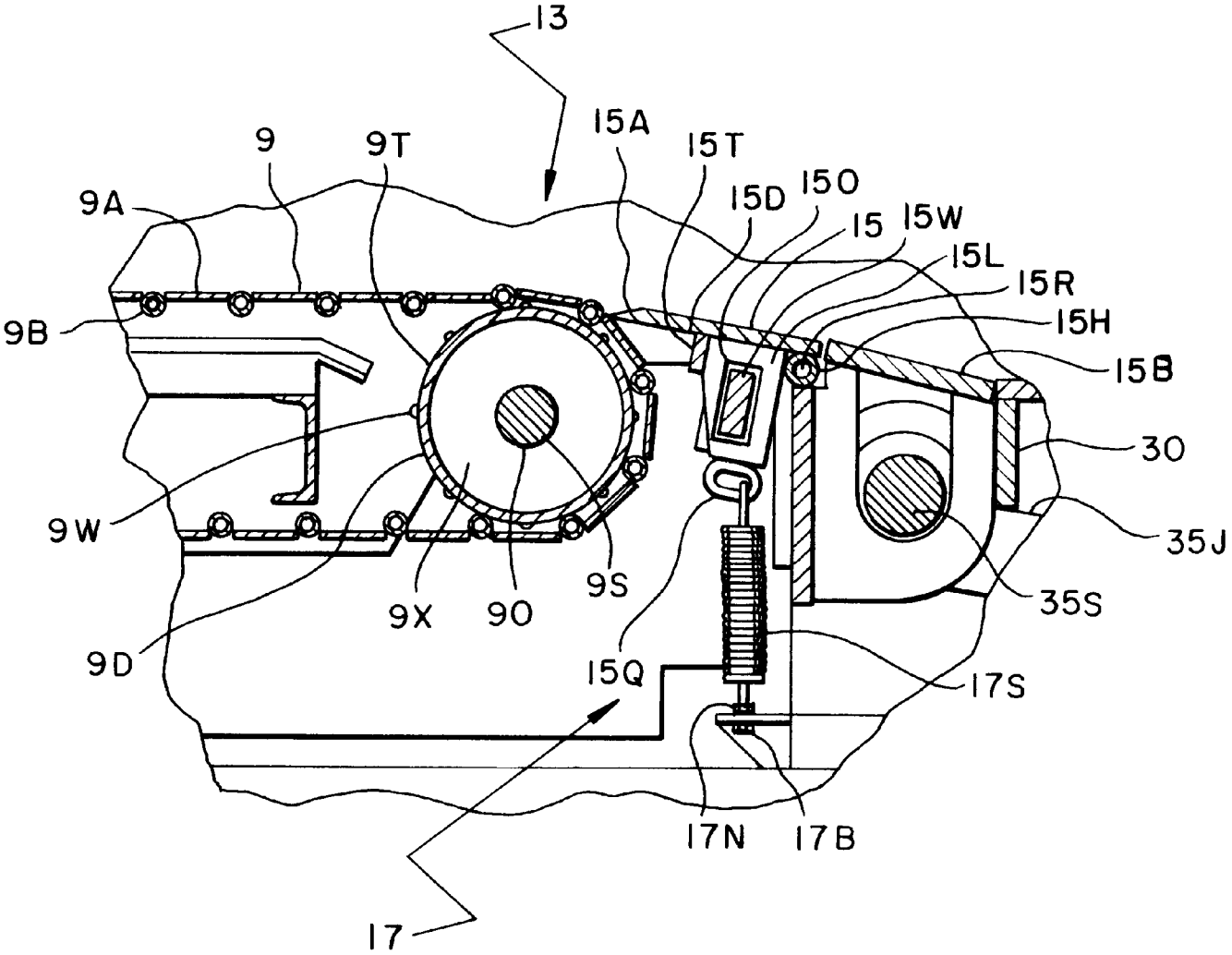
FIG. 5 is an enlarged vertical, cross-sectional view taken in part along line 3—3 showing in greater detail a stripper plate unit shown in FIG. 3.

The depicted apron 9 includes a series of rectangularly-shaped, flat-surfaced metal sections 9A hinged crosswise with laterally disposed piano hinges 9B alternatingly and intertwinely welded along the sides of adjacently positioned sections 9A. Pulleys 9D and 9E may be illustratively fabricated from 8" O.D. steel tubing stock 9T. Drive pulley 9D is appropriately equipped with a series of parallel hard weld beads 9W measuring about a ¼" radius in size welded crosswise at laterally spaced intervals onto tubing stock 9T as shown in FIG. 5 so as to provide sprocketed ridges for gripping and propelling apron hinges 9B about drive pulley 9D. Shaft support sidewalls 9X (at tube 9T ends) form a sidewall closure to tubular tube 9T ends as well as providing mounting for feed shaft 9S which may be directly welded to shaft housing apertures 9O of sidewalls 9X. It is desirable to prevent wastes W from accumulating upon the inner apron 9 surface as well as the feed surface. The inner apron 9 surface may be cleaned by providing idler pulley 9E with augered flighting (left handed and right handed flighting, not shown) which serve to remove waste residue accumulations from the underside of apron 9.

Feed apron motor $M_F$ effectively serves to drive apron 9 by means of feed motor drive pulley (not shown) which belt drives feed belt 9F, feed running pulley axially mounted feed shaft 9S and apron drive sprocket 9P.

A power feeder (designated in general as 8), in cooperative association with apron 9, uniformly feeds and distributes waste bulk W to fragmenting zone 4 at a proper positioning for fragmentation by fragmenting rotor 40. Power feeder 8 contains of a series of projecting feeding teeth 8A positioned for counterclockwise rotational movement upon power drum 8D. Power feed shaft 8S connected to drive sprocket 8P driven by chain 8B, drive sprocket (not shown) and motor $M_P$ serves to locomote power feeder 8. The feed depth, or clearance, of power feeder 8 is regulated by a hydraulic cylinder 8H connected to a suitable hydraulic fluid power source (not shown) which provides an adjusting means for adjusting the power feeder 8 to the appropriate clearance for feeding wastes W. Hydraulic cylinders 8H are also preset to withstand a predetermined back pressure so as to permit power feeder to float upon waste materials fed upon apron 9.

In the preferred embodiments, cleaning assembly 13 cooperatively includes a rigid conveying apron 9 and an adjustable floating stripper plate 15 equipped with a scraper blade 15A which tangentially contacts against apron 9 and scrapes waste residues W from apron 9. As further shown by the cross-sectional views of FIGS. 2, 6 and 9, stripper plate 15 and its scraper blade 15A extends crosswise across the entire width of apron 9. Apron 9 is suitably constructed of materials possessing sufficient rigidity against which floating blade 15A may then apply a sufficient scraping force so as to effectively remove waste residues W from the transporting surface of apron 9.

Cleaning assembly 13 preferably includes an adjustable biasing means 17 for adjusting the amount of tension applied by the stripper plate 15 against apron 9. The stripper plate 15 is designed so as to float along the surface of apron sections 9A and hinges 9B as apron 9 is continuously driven about drive pulley 9D. Stripper plate hinge 15H (positioned at an opposite end of stripper plate 15 from scraper blade 15A) provides a floating pivotal or axial mount for stripping plate 15. Hinge 15H may be suitably constructed as a piano hinge which extends crosswise across the entire width of stripper plate 15. Hinge 15H may be illustratively constructed of 2" length by ¾" I.D. steel bushing stock 15P alternately welded to support frame 16 and underside of stripping plate 15 to provide a piano hinge of intermeshing and aligned bushing stock hinges 15P hinged together by 11/16" O.D. rod stock 15R.

The depicted cleaning assembly 13 includes two anchor bar hold-down springs 17 laterally secured at opposing bar 15W ends by hold-down brackets 15L by chain links 15Q directly welded or secured to hold-down brackets 15L. Hold-down spring 17 comprises an adjustable tension spring 17S equipped with an adjusting bolt 17B and nut 17N which permits the tension of spring 17S to be adjusted to the appropriate stripper plate 15 tension.

Discharging plate 15B collects wastes distributed by distributor plate 15D and discharges the scraped wastes W to the fragmenting zone 4. The distributor plate portion 15D of stripping plate 15 includes a reinforcement bar 15T and a series of hold-down brackets 15L fitted with anchor bar apertures 15O which serve to house a stripper plate anchor bar 15W. Anchor bar 15W extends across the entire crosswise width of stripping plate 15 and externally protrudes outwardly from covering 18 so as to permit a machine operator to make external adjustments of anchor bar 15W. Hold-down brackets 15L may be fabricated from a series of flat stock plate (e.g. four or more) fitted with aligned anchor bar apertures 15O for housing and retaining anchor bar 15W. As may be observed from the Figures, the distributor plate 15D, scraper blade 15A. hold-down brackets 15L and anchor bar 15W freely float about hinge 15H. As may be further observed particularly from FIGS. 4–6, anchor bar 15W is externally fitted with anchor bar adjusting means (generally shown as 17) which, upon tightening, serves to limit the upper movement of stripper plate blade 15A more firmly against apron 9 and upon untightening to allow a greater clearance of blade 15A against apron 9. The adjustable anchor bar 15W, when properly adjusted, serves as a safety stop so as to protect both the stripping blade 15 and apron 9 from damage.

The basic fragmenting components of the fragmenting means 4 comprise a fragmenting rotor (generally referenced as 40) equipped with impacting teeth 41 carried by rotor 42, and a releasable cradle assembly 30 equipped with a striking bar 33 and a grating screen 43. Rotor 42 axially mounted to rotor shaft 42S is rotationally driven by running pulley 42R, belt 42B, drive pulley 42D and motor $M_R$.

The cross-sectional views of FIGS. 3, 5–6 and 9–11 depicts in greater detail the cooperative operational relationship between feed apron 9, the power feeder 8, stripper plate 15, striking bar 33 and the impacting teeth 41 of the rotor 42. The adjustable floating stripper plate 15 cleanly strips waste materials W from the apron 9. Waste materials W fed onto the cutting zone or radii of rotating teeth 41 are fragmented to smaller sized particles as teeth 41 impact upon the waste material W supported upon the striking bar and projecting onto the fragmenting zone 4. Material fragmented by the impacting teeth 41 is then radially propelled along the curvature of the screen 43. Screen 43, in cooperation with the impacting teeth 41, serves to further fragment by grating the waste materials W upon the screen surface and to refine the waste into a desired particle screening size until fragmented to a sufficient particle size so as to screen through screen 43 for collection and discharge by discharging conveyor 51.

Initial fragmentation of the waste feed W is accomplished within a dynamically fragmenting zone 4 comprised of a unique striking bar 33 and a cylindrical rotor 42 equipped with a dynamically balanced arrangement of breaker teeth 41. The striking bar 33 serves as a supportive anvil for shearing waste material W fed to the fragmenting zone 4. Teeth 41 are removable and may be bolted to rotor 42. As may be observed, teeth 41 are staggered upon rotor 42 and dynamically balanced. Rotor 42, when operated at an operational rotational speed of about 1800 rpm, rotates about shaft 42S in complete balance. This permits it to move freely without excessive vibration or unbalance about shaft 42S in a rotationally balanced relationship upon rotor 42.

Upon impacting against waste W supported by striker bar 33, the shearing breaker teeth 41 pull and shred the supported waste W in a downwardly and radially outwardly direction away from a cutting edge of the striking bar 33. The teeth 41, which exert a downwardly and radially outwardly pulling and shearing action upon waste material W resting upon the anvil 33, are preferably positioned (in relationship to a vertical line intersecting the axial shaft 42S of the rotating cylinder 42 assigned a value of 0 degrees) so as to make initial contact upon the waste W at a radial arc ranging from about 26° to about 36° angle. the counter-clockwise rotating cylindric movement of rotor 42 equipped with tangential disposed removable breaker teeth 41 is preferably positioned from about a 64° angle to about a 76° angular relationship to the striker bar 33. The net effect of this arrangement results in a highly effective shearing or fragmentation of the waste materials W at the striking bar 33 site.

Figure 3:
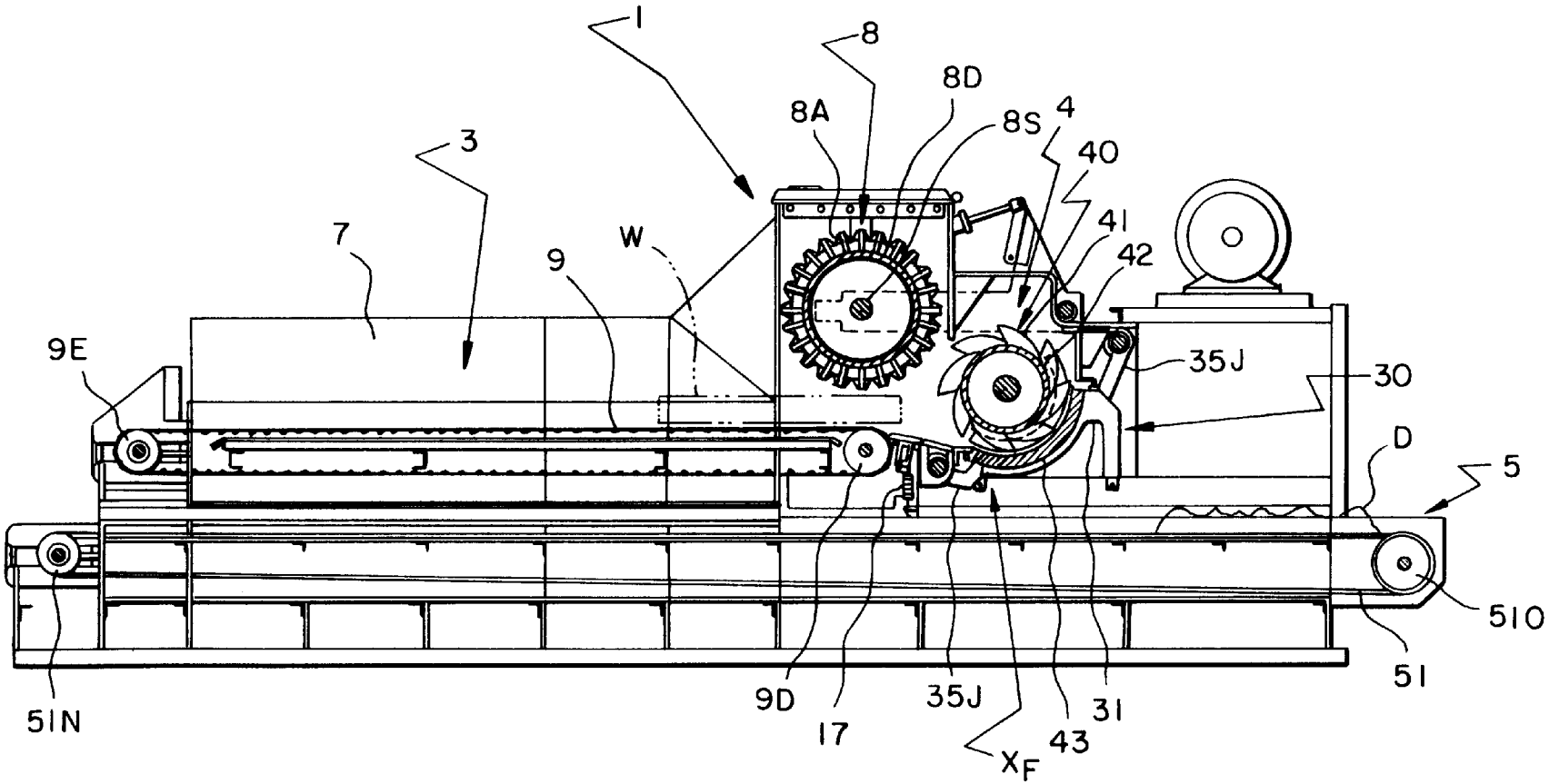
FIG. 3 is a vertical cross-sectional view of the device shown in FIG. 1 taken along line 3—3 of FIG. 2.
Figure 4:
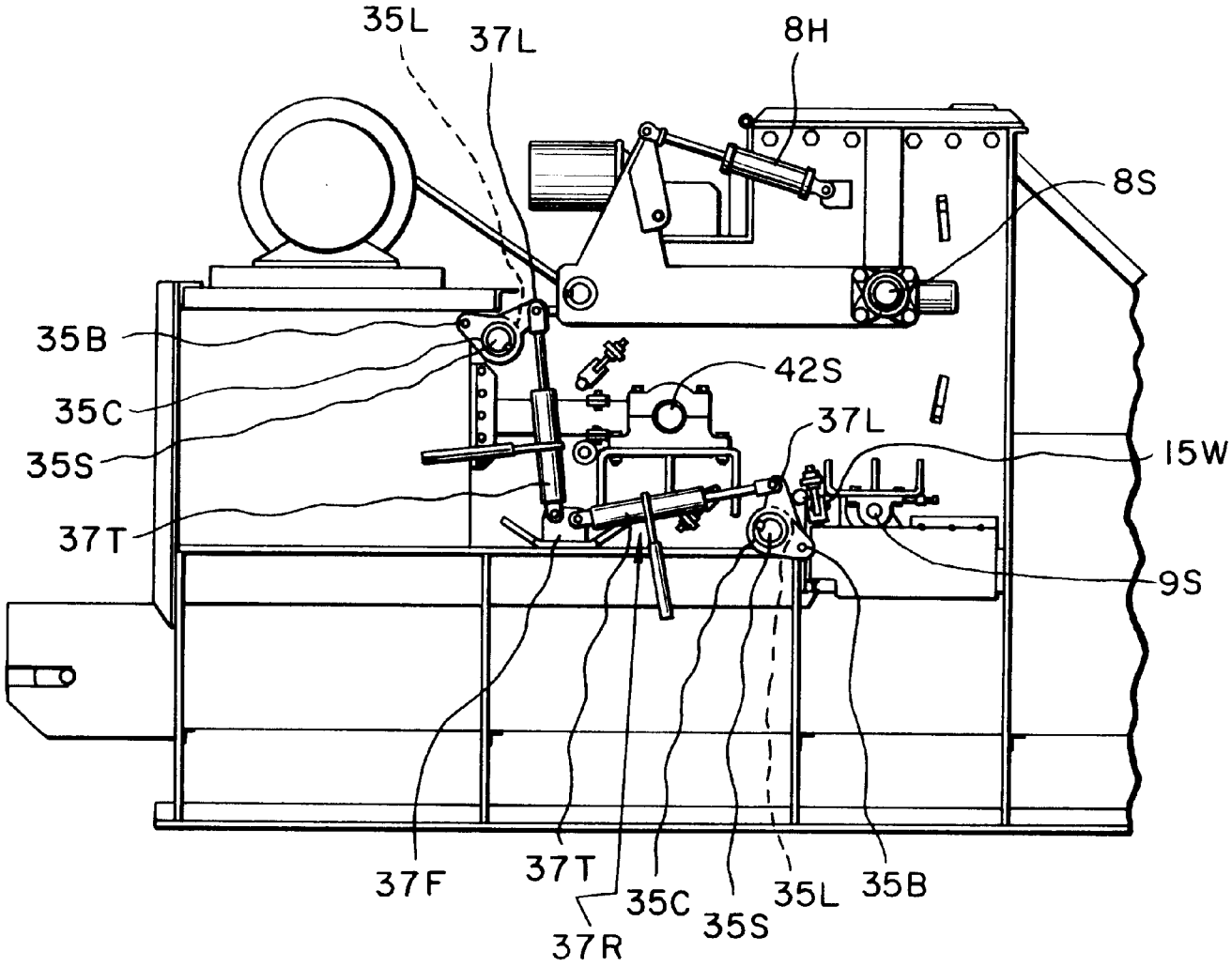
FIG. 4 is a partial view showing an opposite side of the device shown in FIG. 1.

FIG. 3 depicts a cross-sectional view of the cradle assembly 30 and its cooperative operational relationship within machine 1. FIGS. 4 and 6–13 show in greater detail its operative structure. As may be particularly observed from FIGS. 6–11, cradle assembly 30 includes an open cradle frame (generally designated as 31) equipped at opposite screen 43 ends with curved seat sections 31C which mate onto the curvature of discharging side of screen 43. Anchoring seats 31A matingly and fixedly retain screen 43 at an appropriate cradling position upon cradle frame 31. Frame 31 is structurally supported by two laterally disposed curved seat sections 31C positioned at each screen length end for cradling screen 43 secured together as an open framed structure by supportive cross beams 31B, striking bar 33 and latching flange 35F welded to curved section 31C. Frame 31 includes a pair of latching support bars 31F which run along the entire crosswise length of frame 31 to provide a latch site 35F for latching jaws 35J. The latching support bars 31F provide added support for the seated cradle sections 31C. As may be observed from FIG. 8, the discharging underside of screen 43 is fitted along its peripheral margin with crosswise extending interlocking bars or beam 43A for mating placement into a series of corresponding notches or grooves of anchoring seats 31A provided within cradle frame 31. When screen 43 is positioned at a fragmenting position, cradle frame 31 firmly anchors and maintains screen 43 at the appropriate position for screening and fragmenting wastes W.

The leading lip edge of frame 31 includes a case hardened striking bar 33 which extends cross wise across the entire width of cradle frame 31 and provides further structural support to the cradle assembly 30. Striking bar 33 serves as an anvil firmly bracing wastes W for fragmenting upon by impacting rotor 40. Cradle frame 31 is supported at opposite cradle ends by caster legs 31L fitted with casters 31W which ride upon caster rails 16R disposed along inner frame 16 of machine 1. The railed casters 31W permit the entire cradle assembly 30 to be withdrawn to a convenient working position for removing and replacing screen 43.

The waste recycling machine 1 of this invention embodies a unique releasing means 35 for disengaging a unique cradle assembly 30 from a fragmenting position upon subjecting the cradle assembly 30 to an excessive shearing force. The cradle assembly 30 includes a striking bar 33 and a screen 43 uniquely cradled and held in position by cradle frame 31 which, upon exposure to excessive shear, will instantaneously disengage from an operational position to a non-operating or unlatched position. Accordingly, when machine 1 is exposed to a potentially damaging obstacle within fragmenting zone 4, which obstacle creates an excessive level of shear force within the fragmenting zone 4, the fragmenting workings of machine 1 will become disengaged so as to prevent damage to machine 1.

Cradle assembly 30 embodies a unique shear releasing means 35 or mechanism which allows cradled screen 43 and striking bar 33 to cleanly break away from the fragmenting zone 4 when subjected to a damaging obstacle which creates a damaging force exceeding the threshold of shearability for the machine 1. Potentially damaging obstacles such as large sized heavy metal objects (e.g. steel rods, tools, etc.) are illustrative of unfragmentable objects which are capable of causing considerable damage to both machine 1 and operating personnel if the fragmenting means 4 cannot be abruptly terminated. Similarly, excessive compaction of wastes W within the fragmenting zone 4 can also cause damage and injury if the fragmenting operation is not promptly terminated. Machine 1, however, is specifically designed so as to effectively fragment wastes without excessive compaction of wastes W within the fragmenting zone 4. By referring particularly to FIGS. 9–12, it will be observed the radial margins of cradle frame 31 are axially supported by releasable cradle support means 35 for releasing cradle assembly 30 when exposed to excessive shear. The releasing means includes a pair of cradle shafts 35S which extend across the entire peripheral screen 43 width with each shaft 35S being equipped at one terminating end with a pair of radially extending arms 35L and 37L, one of which (the adjusting or ratcheting leg 37L) is connected to ratcheting adjusting means 37R and the other (shear pin leg 35L) which includes a shear pin or bolt receiving aperture 35O. Cradle shafts 35S are equipped with collars 35C fitted with latching jaws 35J which, when latched, latch onto latching flanges 35F.

Figure 10:
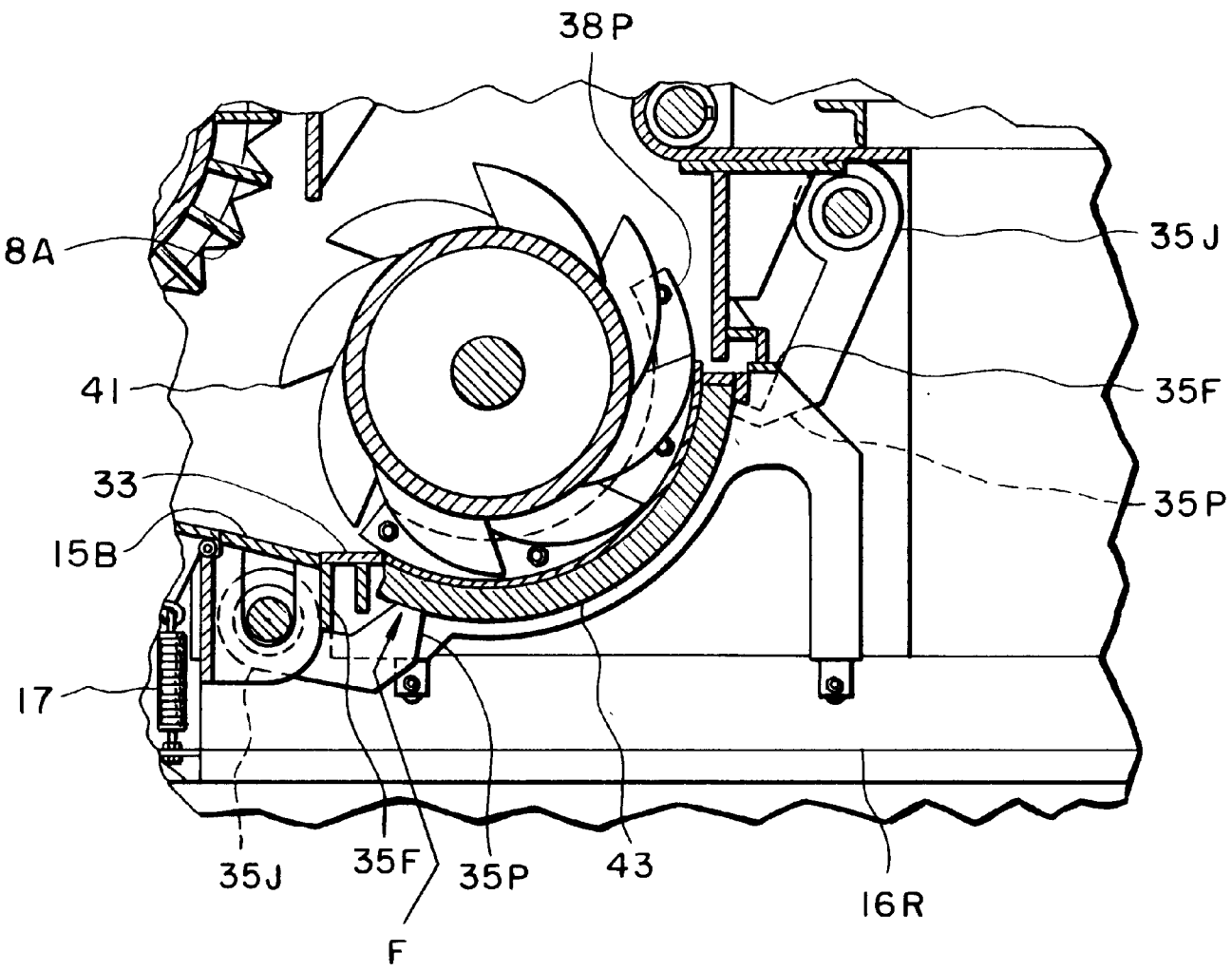
FIG. 10 depicts an enlarged partial, cross-sectional view of a portion of the device depicted by FIG. 3 with the screen assembly being shown in the latched position.
Figure 11:
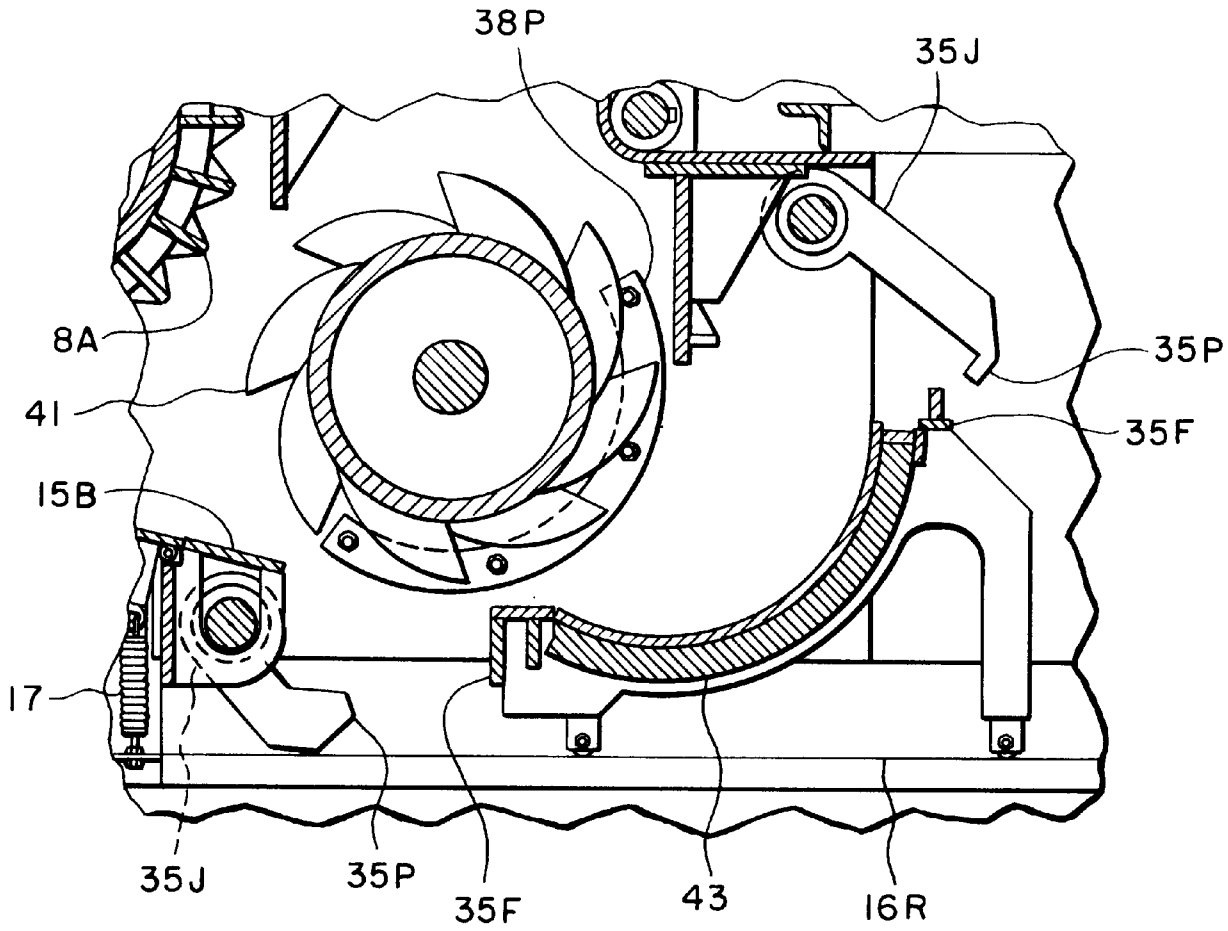
FIG. 11 depicts another cross-sectional view of FIG. 10 showing the screen assembly of FIG. 10 positioned in an unlatched position.

The cross-sectional views of FIGS. 10 and 11 respectively depict the cradle assembly 30 in a latched and fragmenting position and an unlatching (non-fragmenting) position. FIG. 11 shows the latching jaws 35J in a released position with screen 43 and cradle assembly 30 being depicted in a non-operative and released position while FIG. 10 depicts the cradle assembly 30 in the latched fragmenting position. When it is desired to place the screen 43 in a latched and operative position, cradle assembly 30 is pushed inwardly and upwardly until jaws 35J latch onto latching flanges 3SF and secure screen 43 and striking bar 33 in the latched position as shown in FIG. 10.

Cradle assembly 30 includes a pair of axially mounted latchings shafts 35S positioned at opposite screen ends with each shaft 35s fitted with latching arms 35J anchored (e.g. welded) to latching shaft 35S. Latching projections 37J of latching arms 35J shoulder against latching flanges 35F of cradle frame 31 when latched and retain cradle frame 31 in a latched position as may be observed from FIG. 10. As may be further observed from FIGS. 4, 9 and 12, latchings shafts 35S are each externally fitted with a shearing leg 35L securely affixed (e.g. welded or bolted) to latching shaft 35S. Shearing leg 35L is fitted with a shear pin receiving aperture 35O for receiving a shear pin or shear bolt 35B. Shear pin leg 35L is connected to ratcheting leg 37L by shear bolt 35B seated within a shear bolt receiving aperture 35O of shear pin leg 35L and receiving aperture 37O of ratcheting leg 37L. When secured to shear pin leg 35L, ratcheting leg 37L is designed so as to rest at an acute angular relationship with shear pin leg 35L. Ratcheting leg 37L is journaled onto collar 35C which permits ratcheting leg 37L to freely rotate about collar 35C and latching shaft 35S when not securely bolted by shear bolt 35B onto shear pin leg 35L.

The releasing means 35 for disengaging the cradle assembly 30 from the fragmenting position (latched) as shown in FIG. 10 to disengaged position (unlatched) as depicted in FIG. 11 is triggered by a shearing of a shear bolt 35B at either or both of the shear apertured bolt locations 35O. As may be observed from FIG. 10, latching arms 37J maintain cradle assembly 30 in an operative fragmenting position until a shearing force exerted by a high shear obstacle causes at least one or both shear bolts 35B to shear. Shearing of shear bolt 35B disconnects the connecting link between shear pin leg 35L and ratcheting leg 37L causing ratcheting leg 37L and the latching collar 35C to freely rotate and release latching arms 35J from cradle flange 35F. This allows the unlatched cradle assembly 30 to be safely removed by gravitational and shearing forces to a safe clearance from the damaging effects of an unshearable object lodged within the fragmenting zone 4. Depending upon the location and potential damaging effect of the shear causing obstacle, either one or both shear bolts 35B and support provide screen ends may become unlatched to a protective clearance from the obstacle. A particular advantage of the preset release mechanism resides in the instantaneous spontaneity for releasing the cradle assembly 30 from harmful objects.

In operational use, clearance adjusting means 37 are adjusted to the appropriate clearance for effective processing of wastes. The adjustable clearance means 37 for adjusting cradle assembly 30 to appropriate fragmenting clearance position is accomplished by ratcheting turnbuckles 37T which are operatively connected to ratcheting legs 37L. As may be observed from FIGS. 9 and 12, one end of each turnbuckle 37T is pivotally anchored to turnbuckle mount 37F while an opposite end of the turnbuckle 37T is pivotally mounted to ratcheting leg 37L by ratcheting leg mounting pin 37M. By ratcheting turnbuckles 37T together, ratcheting leg 37L causes latching shaft 35S to rotate and draw cradle assembly 30 including the cradled screen 43 and striking bar 33 in closer proximity to the impacting teeth 41 of rotor 42. By untightening tumbuckles 37T, latching shafts 35S rotate in an opposite rotational direction causing a greater clearance and distance between cradle assembly 30 and teeth 41. When adjusting tumbuckles 37T to the appropriate clearance for smooth operation, the operator may listen to the smoothness of the fragmenting process and adjust the turnbuckles 37T to the smoothest operation similar to the manner an experienced mechanic adjusts a carburetor or timing in automotive repair.

The screen assembly includes screen stop adjusting means (generally referenced as 38) which serves as a safety stop for preventing screen 43 to be drawn too close to impacting teeth 41. The stop comprises a curved plate 38P of a concentric curvature mating to the feed side of screen 43. Curved plate 38P fits along both outer arcuate margins of screen in juxtaposition to covering 18. Adjusting stop nuts 38N welded to stop plate 38P provide threads for threaded bolts 38B for positionally adjusting stop plate 38P. The threaded bolts 38B are connected to adjusting plate 38A fitted with a threaded rod 38R mounted to the outside of casing 18. By adjusting threaded rod 38R, adjusting plate 38A stop clearance of curved stop plate 38P may be, accordingly, adjusted. The adjusting means 38 includes two adjusting rods 38R positioned at the terminal arcuate ends of screen 43 at both screen ends. Thus, the proper alignment for stop plate 38P is generally accomplished by adjusting the four stop adjusting rods 38R to the proper clearance for screen 43. As a result, stop plate 38P serves as a safety stop to stop screen 43 from being ratcheted by adjusting means 37 to an unsafe clearance.

Figure 2:
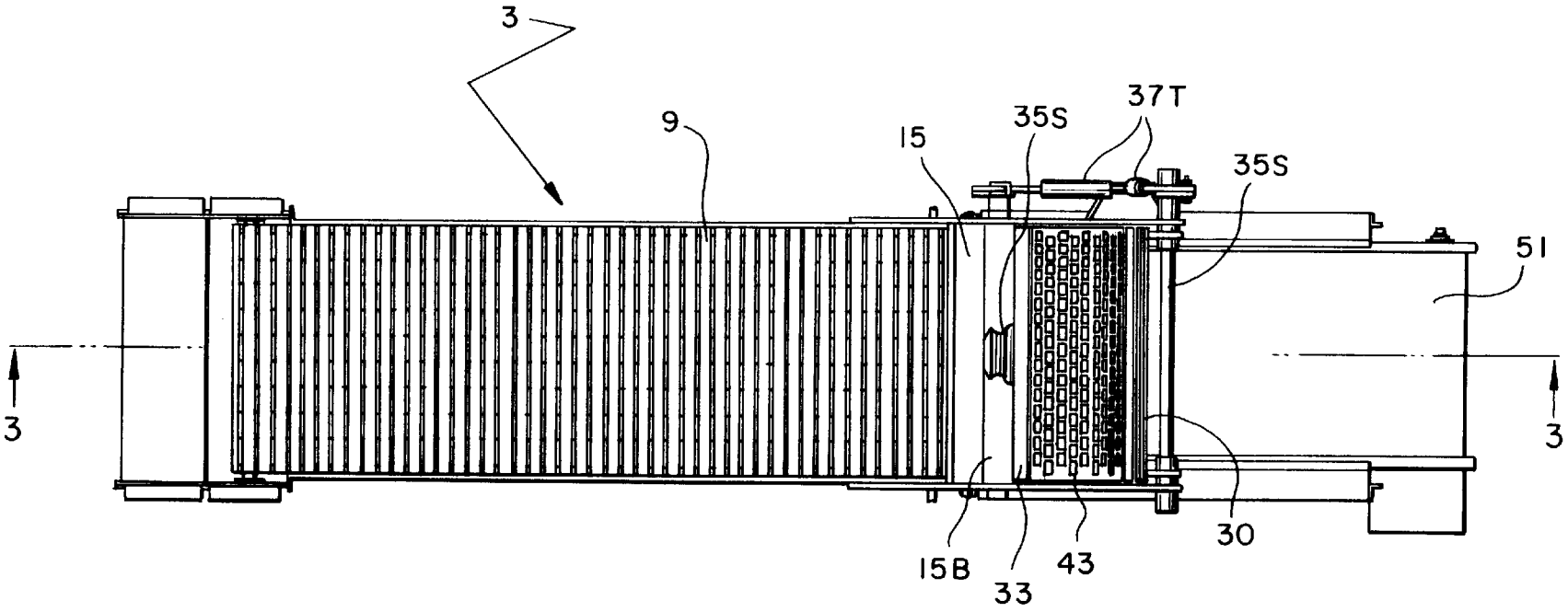
FIG. 2 is a horizontal cross-sectional view of the device taken along line 2—2 of FIG. 1.

Discharging conveyor (generally designated as 50) extends lengthwise and widthwise along the bottom portion of the device and is driven by motor $M_D$. Materials D fragmented to a particle size sufficient to pass through screen 43 gravitate to discharging conveyor 51 which then transports the desired material D to a suitable collection point. The cross-sectional views of FIGS. 2 and 3 show in greater detail the discharging conveyor 51 and the feed apron 9 as well as the fragmenting zone 4. Similar to the feed apron 9, the discharging conveyor 51 is powered by drive sprocket 51D chain-driven by chain 51B, drive pulley (not shown) and running pulley 51R which, in turn, powers running sprocket 51O and laterally disposed spacer sprocket 51N positioned at the feed end of the machine 1.

Figure 14:
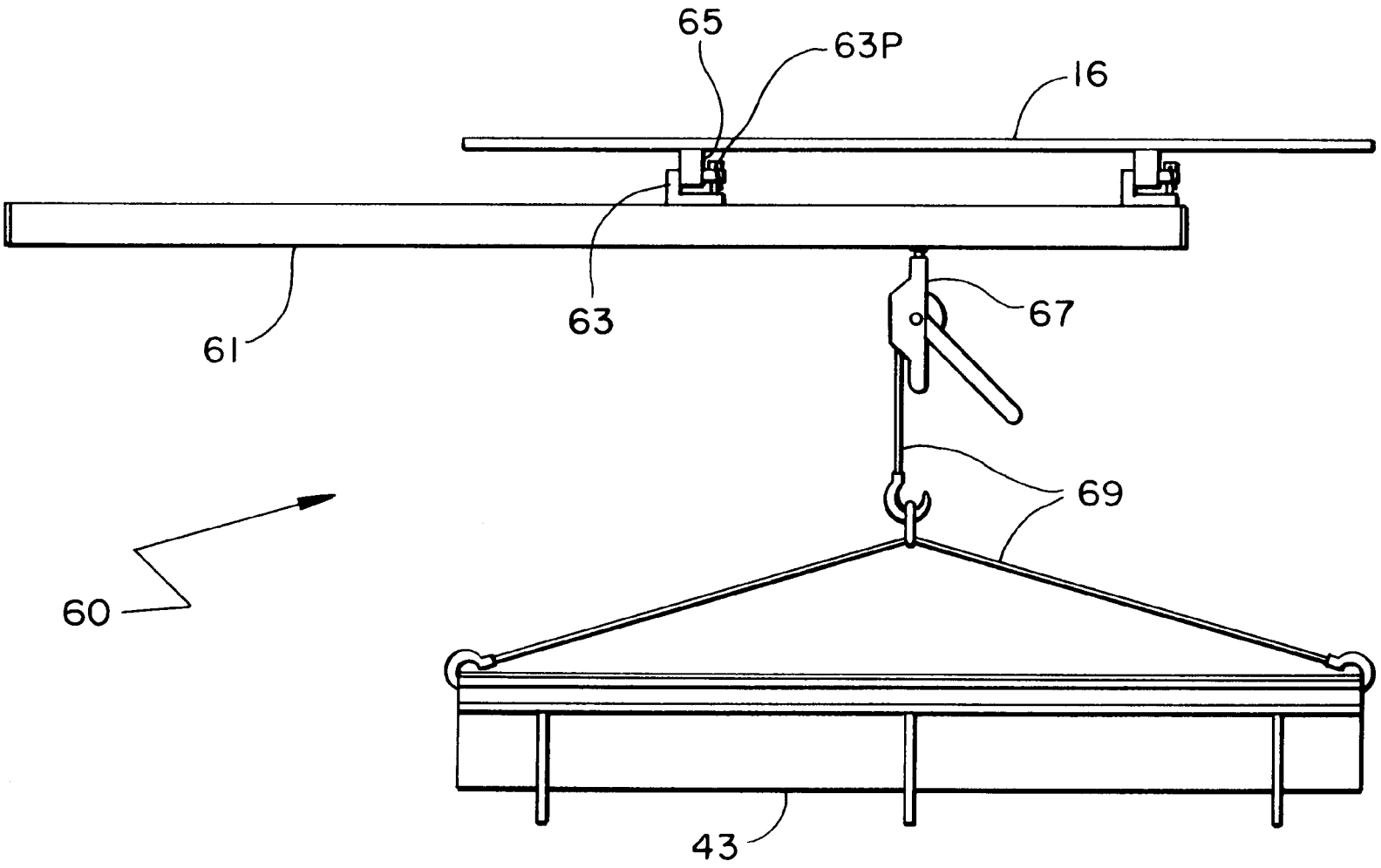
FIG. 14 depicts a side view of a screen lifting assembly useful for replacing screens of the cradle assembly.

FIG. 14 depicts a screen lifting assembly (generally designated as 60) which permits a single operator to replace screen 43 without assistance by others. As mentioned, cradle assembly 30 is fitted with castors 31W which ride upon caster rails 16R disposed along inner frame 16. This permits screen assembly 30 to be removed from fragmenting zone and moved to a convenient open position for removing screen 43. The screen lifting assembly 60 includes trolley boom 61 equipped with boom mounts 63 which anchor and pin onto boom assembly mounts 65 secured to the discharge cover area of covering 18 laterally disposed above rails 16R. When using lift assembly 60, the operator simply unlatches cradle assembly 30 as shown in FIG. 11 and rails cradle assembly 30 to a position directly below boom anchor mounts 65. Boom 61 is then inserted via boom mount 63 onto anchor mounts 65 and secured thereto with lynch pins 63P. Jack 67 (e.g. two ton come-a-long) is secured onto boom 61 and lift chain 69. Screen 43 may then be lifted from cradle assembly 30, then trolleyed along boom 61 until clear of machine 1. By reversing the aforementioned procedure, a replacement screen 43 may be placed upon cradle assembly 30 and railed into operational or latched position as shown in FIG. 10.

The rotor 42 is spin-balanced. The placement of teeth 41 and balancing provides a dynamically balanced fragmenting rotor 40 which, when used in combination with the striking bar 33 and screen 43, provides significantly improved efficacy in the processing of recyclable waste materials W. These features allow machine 1 to operate more effectively with less power and higher capacity than conventional waste recycling machines.

Figure 6:
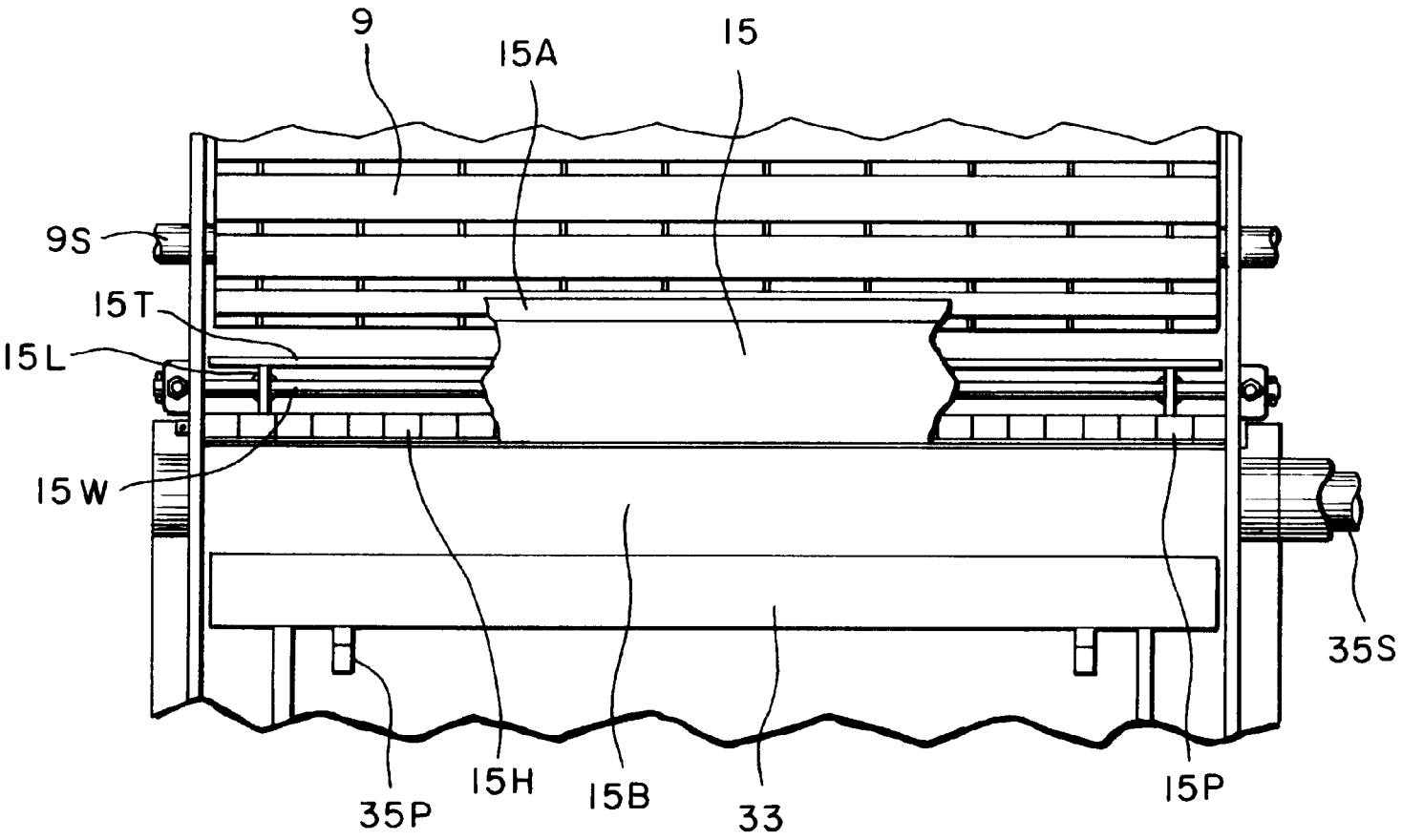
FIG. 6 is an enlarged cross-sectional top view the of the stripper plate unit as shown in FIG. 2.
Figure 7:
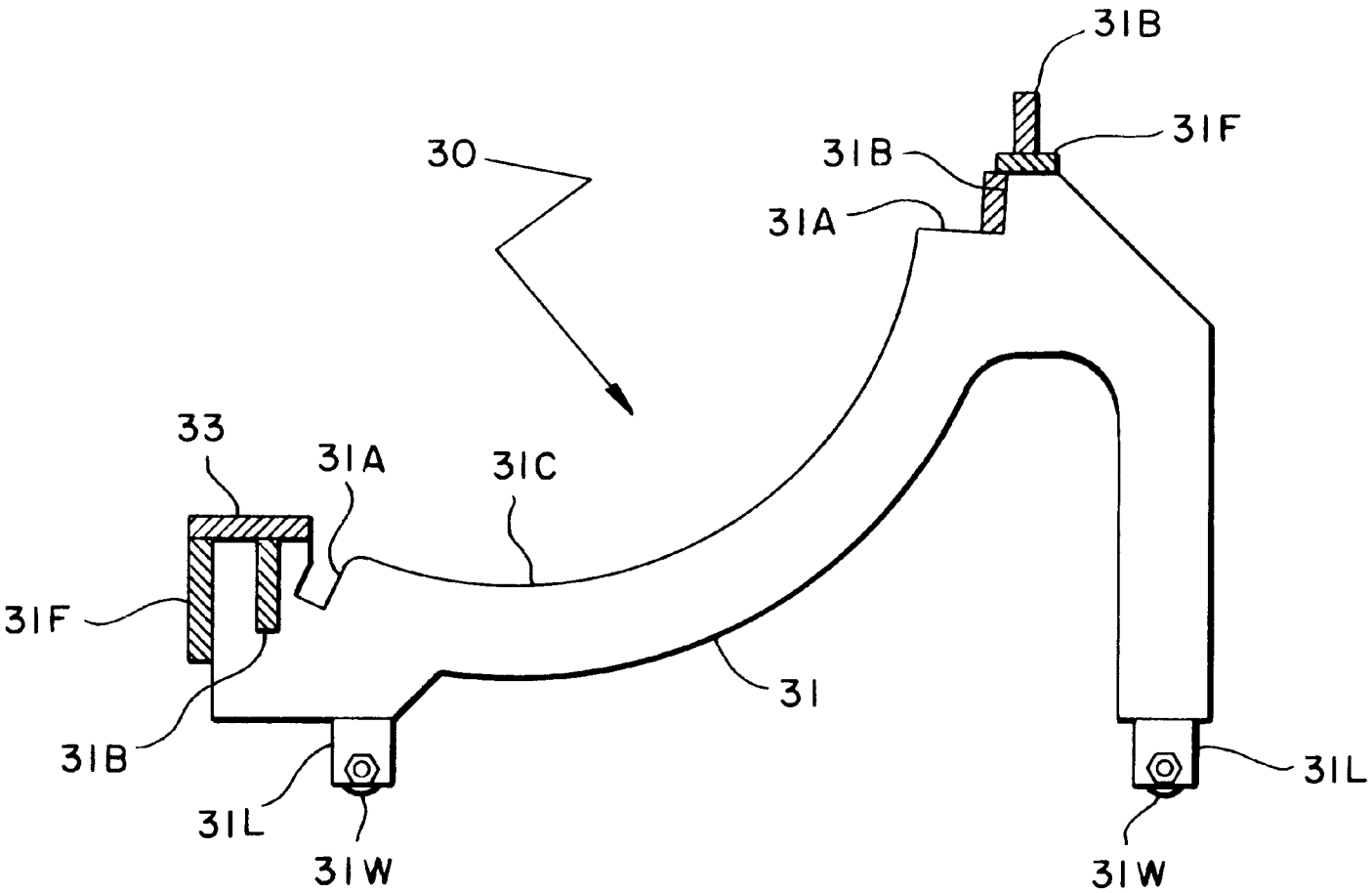
FIG. 7 is an enlarged cross-sectional side view of a supportive cradle frame shown in FIG. 3.
Figure 8:
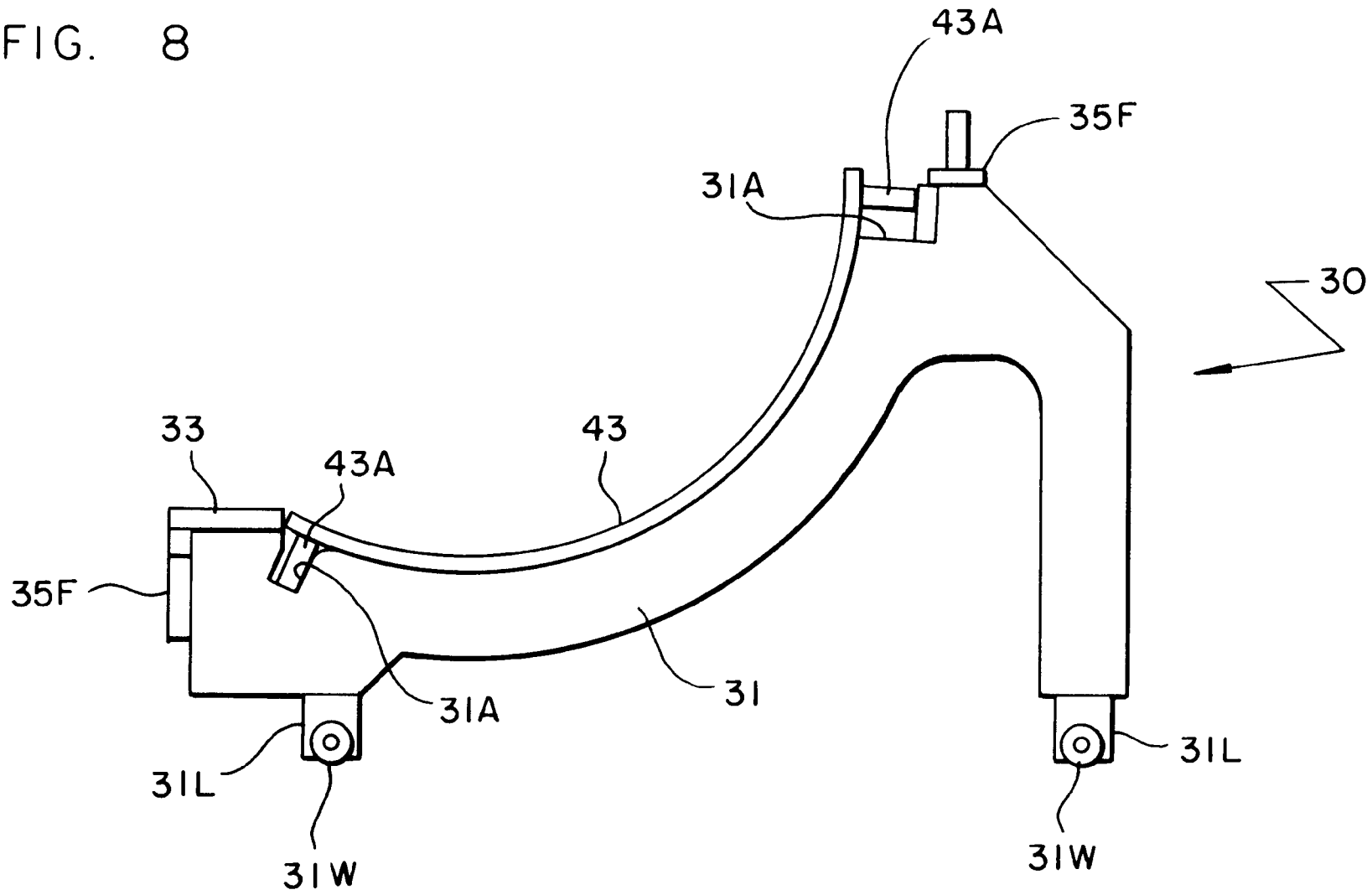
FIG. 8 depicts the supportive cradle frame shown in FIG. 7 with a mounted screen.
Figure 9:
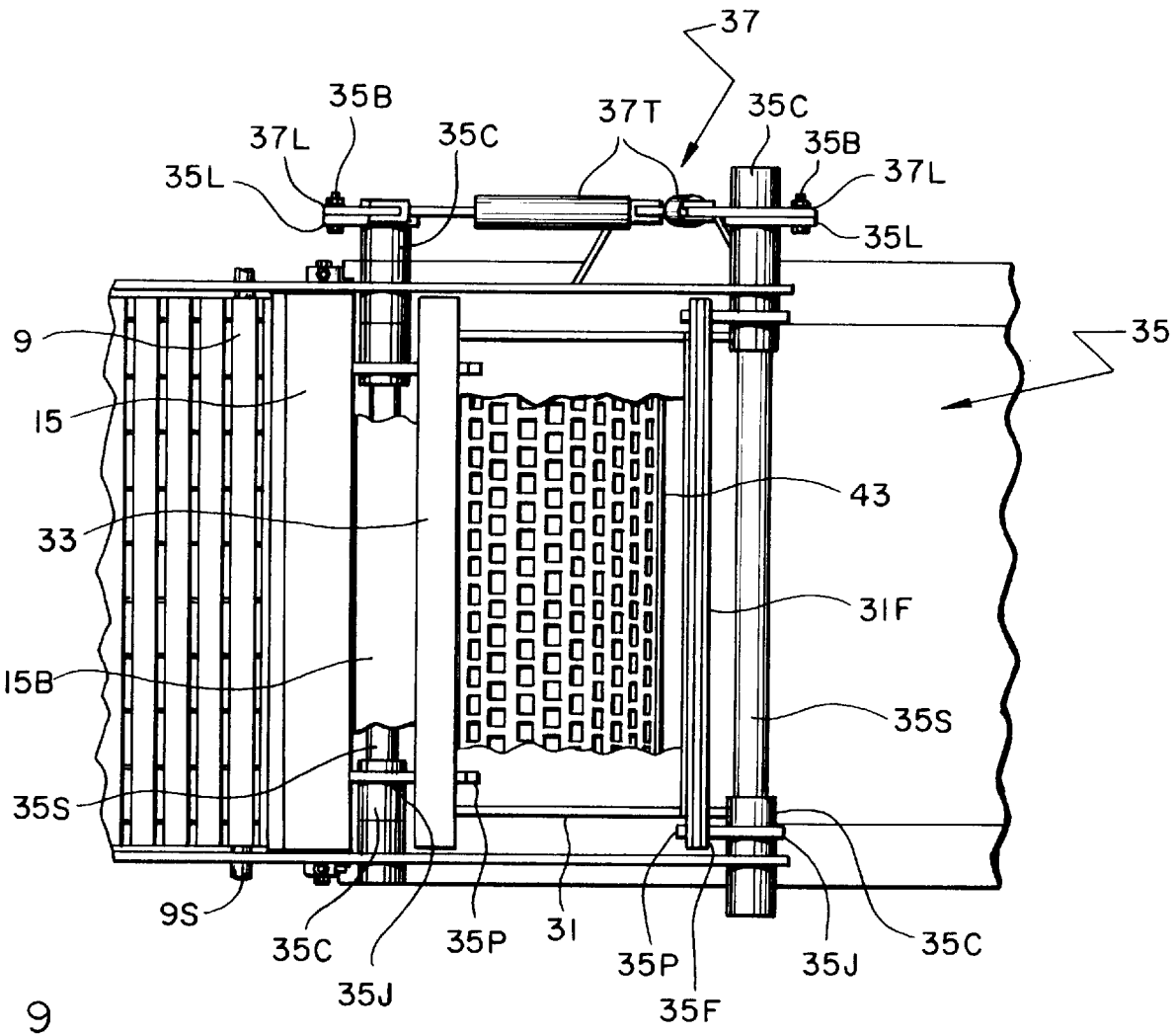
FIG. 9 shows, in part, an enlarged, cross-sectional top view of part of the device shown in FIG. 2.

FIGS. 5 and 6 show a top and side view of the hinging portion of the stripper plate assembly 15. The figures show the releasing means 35 for disengaging the cradle assembly 30 and adjustable clearance means 37 for adjusting the cradle to the desired waste fragmenting position.

Figure 12:
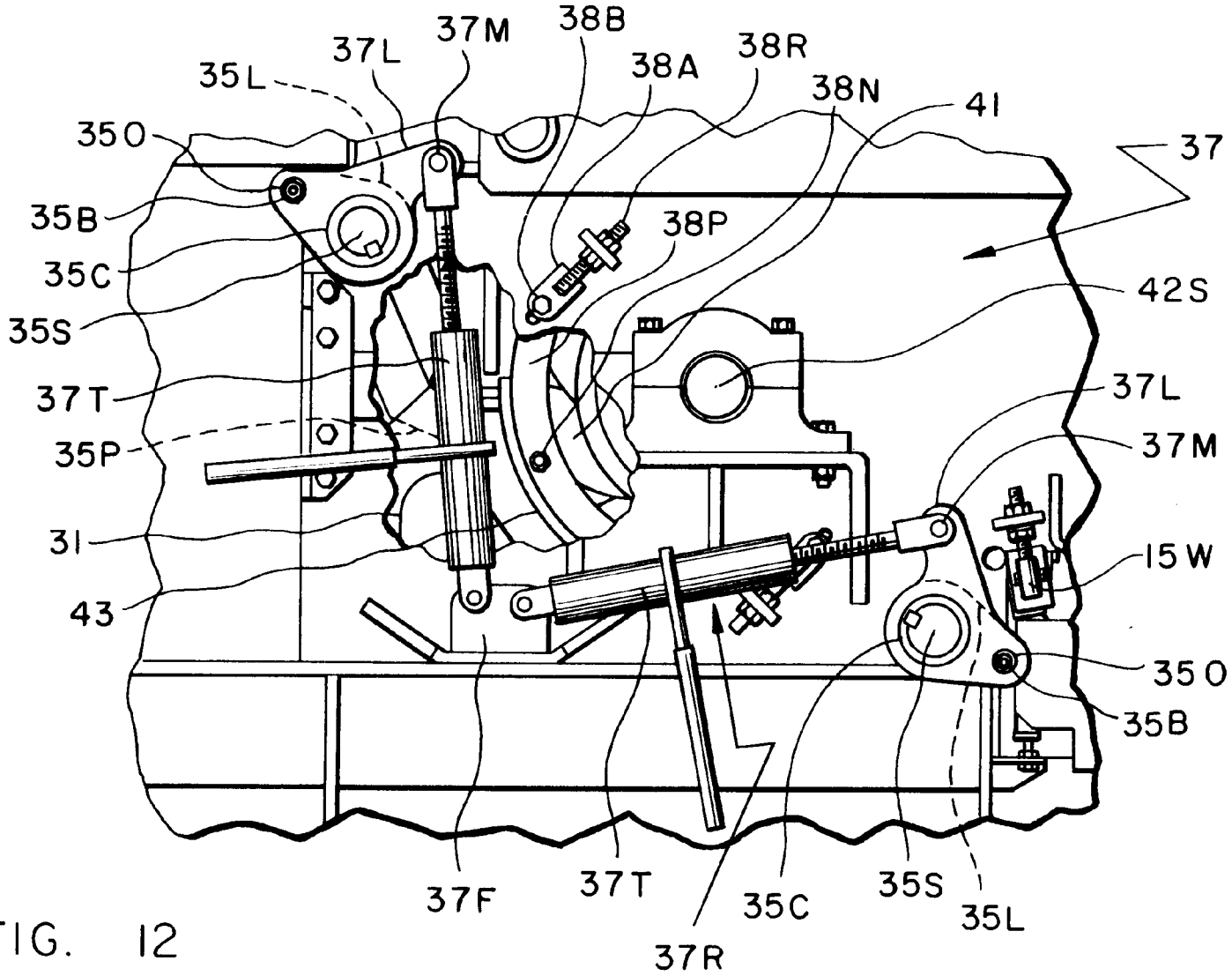
FIG. 12 is a partial enlarged side view of FIG. 4.
Figure 13:
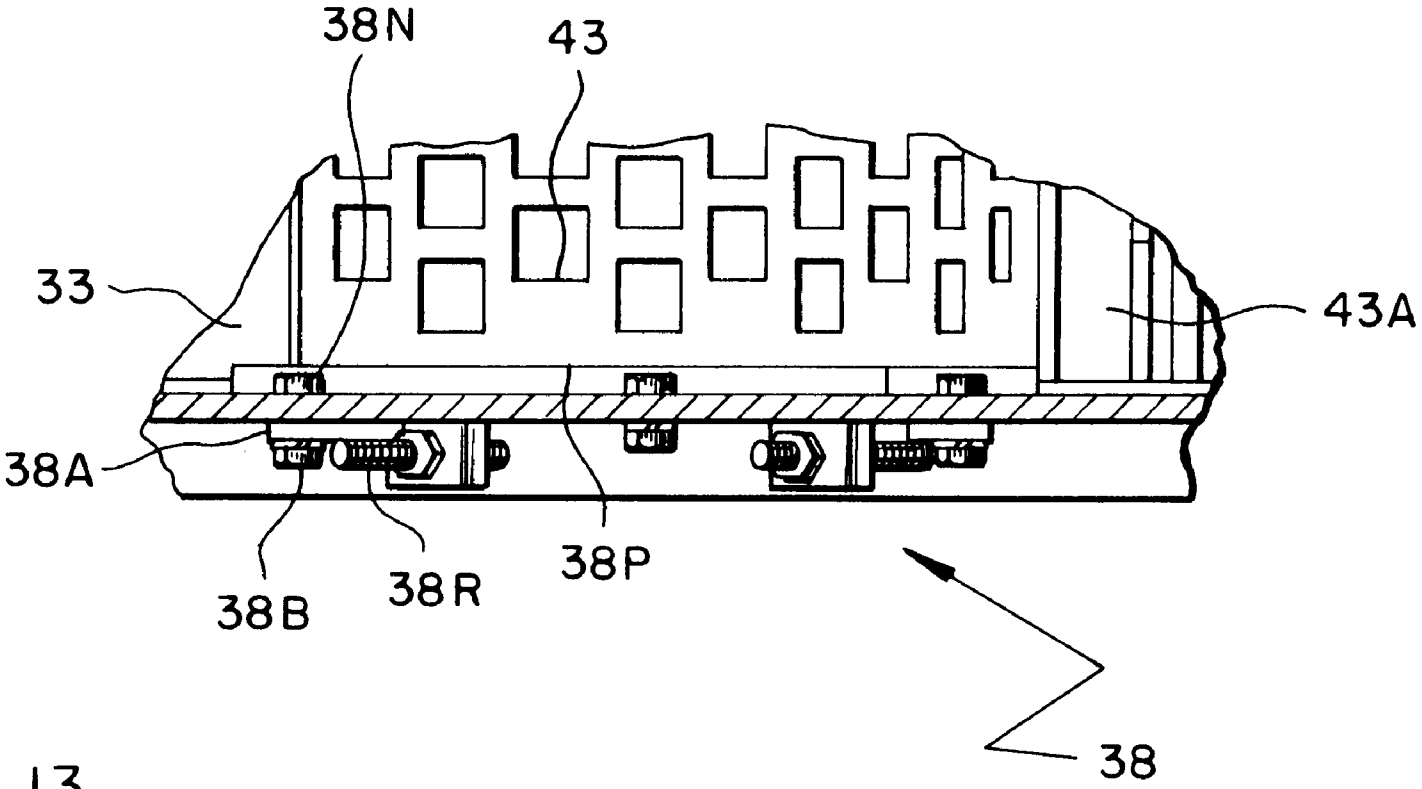
FIG. 13 is an enlarged partial top view of a part of the device shown in FIG. 2.

If desired, the machine 1 may include spiral flightings of feed idler pulley 9E and drive pulley 51D which may be respectively utilized to clean the underside of apron 9 and discharging conveyor. The boom assembly depicted in FIG. 14 shows in greater detail the trolleying features of the boom jack 67. FIG. 12 shows the external features of screen stop adjusting means 38 showing adjusting threaded rod 38R equipped with adjusting nuts for adjusting the clearance stop for screen 43.

Reference is made to our provisional application 60/022,441 entitled the same as this application for which priority is claimed, and the presence in said provisional application of engineering drawings and prints.

What is claimed is:

1. A releasable cradle assembly for use in a waste processing machine comprised of an impacting rotor equipped with impacting teeth rotationally carried about a cylindrical drum, and a separable and removable screen for screening particulated wastes therethrough, said cradle assembly comprising:

a) a supportive cradle frame for supportively cradling the removable screen thereupon;

b) an adjustable striking bar adjustable to a waste fragmenting position carried by the cradle frame;

c) releasing means for disengaging the striking bar of the cradle assembly from the fragmenting position upon subjecting the striking bar to an excessive shearing force; and d) adjustable clearance means for adjusting the striking bar of the cradle assembly to the waste fragmenting position.

2. The assembly according to claim 1 wherein the releasing means comprises a shear pin.

3. The assembly according to claim 1 wherein the cradle frame includes open cradle frame equipped at opposite screen ends with curved seating sections for mating onto a curvature of a discharging side of the screen.

4. The assembly according to claim 1 wherein the releasing means includes a latching shaft, a latching arm and a latch for latching the cradle assembly in a latched position at the fragmenting position.

5. The assembly according to claim 4 wherein the latching shaft includes a shearing leg for receiving and retaining a shear pin when the cradle assembly is latched in the fragmenting position.

6. The assembly according to claim 4 wherein the latching shaft includes a pair of latching arms positioned at opposite ends of the shaft and each of said latching arms includes a shearing leg equipped with a shear pin aperture for receiving and retaining a shear pin therewithin.

7. The assembly according to claim 5 wherein the shear pin comprises a shear bolt for retaining the latching arm in the latched position.

8. The assembly according to claim 1 wherein the cradle assembly is axially mounted to a support shaft at a discharging end of the screen so as to permit the cradle assembly to axially rotate about the shaft when the releasing means disengages the cradle assembly.

9. The assembly according to claim 8 wherein the cradle frame includes the striking bar positioned at a leading edge of the frame.

10. The assembly according to claim 8 wherein the releasing means includes a cammed shearing means operationally connected to the adjustable clearance means.

11. A method for using a waste processing machine comprised of an impacting rotor equipped with impacting teeth rotationally carried about a cylindrical drum, a screen for screening particulated wastes therethrough, a supportive cradle frame for supportively securing the screen thereto; an adjustable striking bar carried by the frame with the striking bar being adjustable to a waste fragmenting position, releasing means for disengaging the striking bar of the cradle assembly from the fragmenting position upon subjecting the striking bar of the cradle frame to an excessive shearing force, and adjustable clearance means for adjusting the striking bar of the cradle assembly to the waste fragmenting position, said method comprising:

a) placing the screen upon the supportive cradle frame;

b) adjusting the striking bar of the cradle assembly to the waste fragmenting position;

c) feeding wastes to the impacting rotor and the striking bar; and d) disengaging the striking bar of the cradle assembly fro the fragmenting position with said releasing means by subjecting the striking bar to the excessive shearing force.

12. The method according to claim 11 wherein following the disengaging of the cradle assembly by the releasing means, the method includes readjusting the cradle assembly to the fragmenting position.

13. The method according to claim 11 wherein the releasing means includes a shear pin which upon subjecting the striking bar of the cradle assembly to the excessive shearing force shears the pin causing the striking bar of the cradle assembly to disengage from the fragmenting position and the method includes replacing the sheared shear pin with a replacement shear pin and a readjusting of the cradle striking bar of the assembly to the fragmenting position.

* * * * *